US006314700B2

(12) United States Patent
Starr

(10) Patent No.: US 6,314,700 B2
(45) Date of Patent: Nov. 13, 2001

(54) ROOF TILE CONSTRUCTION USING SANDWICHED ADHESIVE

(75) Inventor: Cris Damon Starr, Cape Coral, FL (US)

(73) Assignee: Fomo Products, Inc., Norton, OH (US)

( * ) Notice: Subject to any disclaimer, the term of this patent is extended or adjusted under 35 U.S.C. 154(b) by 0 days.

(21) Appl. No.: 09/748,581

(22) Filed: Dec. 22, 2000

Related U.S. Application Data

(62) Division of application No. 09/317,325, filed on May 24, 1999, now Pat. No. 6,206,991.

(51) Int. Cl.[7] ..... E04D 1/00

(52) U.S. Cl. ..... 52/540; 52/518; 52/535; 52/543

(58) Field of Search ..... 52/518, 540, 543, 52/535; 156/71, 77, 78, 79, 291

(56) References Cited

U.S. PATENT DOCUMENTS

| | | | |
|---|---|---|---|
| 2,424,410 | | 7/1947 | Miles . |
| 2,667,131 | | 1/1954 | Clarvoe et al. . |
| 3,042,193 | | 7/1962 | Wendt . |
| 3,050,908 | | 8/1962 | Schenk . |
| 3,080,683 | | 3/1963 | Sallie . |
| 3,180,783 | | 4/1965 | Walker et al. . |
| 3,252,257 | | 5/1966 | Price et al. . |
| 3,511,007 | | 5/1970 | Babcock . |
| 5,362,342 | | 11/1994 | Murray et al. . |
| 5,895,536 | | 4/1999 | Starr et al. . |
| 6,206,991 | * | 3/2001 | Starr ..... 156/71 |

FOREIGN PATENT DOCUMENTS 2 169 329 A 7/1986 (GB) .

OTHER PUBLICATIONS

Information Disclosure Statement filed in U.S. patent No. 5,362,342 with Declaration of Pat L. Murray dated, May 11, 1994.

Declaration of Anthony DeVito filed in U.S. patent No. 5,895,536 dated Jun. 9, 1998.

OSI Brochure showig RT 600 Roof Tile Adhesive—Not dated.

Acceptance Notice No. 96–0320.01 dated Oct. 18, 1996 from Building Code Compliance Dept., Metropolitan Dade County, comprising 10 pages for RT–600 Roof Tile Adhesive.

Copies of general purpose one–component, polyurethane foam aerosol can labels published in Europe believed dating to 1990 (and earlier) comprising 8 sheets marked E–1 through E–8.

Copies of Instruction sheets published in Europe (about 1992) showing gun dispensal of general purpose one–component polyurethane foam comprising 5 sheets marked F–1 through F–5.

* cited by examiner

*Primary Examiner*—Carl D. Friedman
*Assistant Examiner*—Dennis L. Dorsey
(74) *Attorney, Agent, or Firm*—Frank J. Nawalanic

(57) ABSTRACT

A roof construction uses a one-component adhesive to adhere roof tiles to a roof. The adhesive is formed in a U-shaped pattern in that the adhesive is dispensed in a bottom leg deposit on the tile's underside, a bight deposit extending about the tile's leading edge and a top adhesive deposit overlying the bottom deposit and extending on the outside surface of the tile. As the tiles are laid onto the roof in an overlying fashion, the U-shaped adhesive is sandwiched between the tile, the overlying tile and the roof forming sealing contact therewith and therebetween.

4 Claims, 10 Drawing Sheets

ROOF TILE CONSTRUCTION USING SANDWICHED ADHESIVE

This patent application is a division of application Ser. No. 09/317,325, filed on May 24, 1999, now U.S. Pat. No. 6,206,991 B1, and incorporated herein by reference.

INCORPORATION BY REFERENCE

The following patents are incorporated herein by reference and made a part hereof:

My U.S. Pat. No. 5,895,536, issued Apr. 20,1999, entitled "METHOD OF ADHERING ROOF TILES USING ONE-COMPONENT ADHESIVE AND ROOF CONSTRUCTION OBTAINED THEREBY" and U.S. Pat. No. 5,362,342, to Murray et al., issued Nov. 8, 1994, entitled "METHOD OF BONDING ROOF TILES TO ROOF SUBSTRATE UTILIZING URETHANE FOAM".

Neither patent incorporated by reference herein forms any part of this invention. The material is incorporated by reference so that the detailed description of this invention need not set forth in detail prior art construction techniques and methods known in the art as explained in the patents listed above.

This invention relates to roof construction and more particularly to a system, method and apparatus, for securing roof tiles to a roof.

The invention is particularly applicable to and will be described with specific reference to a roof construction using a one-component, polyurethane adhesive froth to attach any conventional roof tile to a roof. However, those skilled in the art will recognize that the invention has broader application and conceivably, could be used with two-component, polyurethane foam adhesives.

BACKGROUND

Roof construction, particularly residential roof construction, varies by climatic location throughout the United States. This invention relates to protective roof coverings formed by roof tiles as opposed to asphalt based roof shingles typically used in the northern parts of the United States to form a protective roof covering. Roof tiles are typically constructed from natural materials such as clay, concrete, stone, ceramics (including brick and fired clay) and have also been made of synthetic material, typically plastic and it is possible to have tiles formed from combinations of natural and synthetic materials, i.e., fibrous cement.

Traditionally, in the United States, roof tiles have been applied with a cementitious material, typically mortar usually mixed at the site. The prior art patents incorporated by reference discuss at length inherent problems encountered when mortar is used to affix roof tiles to the roof substrate and those problems will not be restated herein. However, the prior art patents have not discussed mortar patterns used to affix the roof tiles to the roof. While it may have been conventional at one time to simply place the mortar on the underside of the roof tile, without regard to mortar amount, building construction regulations such as those promulgated by Southern Building Code, Florida, require that no more than 33% of the area underneath the tile be covered by the adhering material. This leaves the space between tiles and between roof and tiles open for air circulation so that the tiles are less likely to be pulled off the roofs during hurricane winds. Accordingly, conventional practice today is to trowel a glob or pad of mortar over the central underside area of the tile (or alternatively, a deposit of the mortar is placed on the roof), which is then flattened somewhat when the tile is positioned onto the roof substrate. Again, the height and area of the mortar pad is such that no more than 33% of the area of the tile is to be covered by the cementitious material. In practice, it sometimes occurs that too little or too much mortar is used which, coupled with the well known adhesive inconsistencies of mortar, results in faulty tile application.

Because of the limitations of conventional cementitious materials, specifically mortar, other types of materials, principally adhesives, have been investigated for use as bonding agents to affix roof tiles to the roof substrate without the need for mechanical fasteners.

A) U.S. Chronology.

Accordingly, at least as early as the summer of 1992, I purchased an off-the-shelf, commercially available, one-component, polyurethane foam in a pressurized aerosol spray type container. The polyurethane foam was applied as a deposit in the shape of a centrally positioned pad, replicating the conventional mortar pad shape and position, and used to affix the roof tiles to the roof. It was found that the polyurethane foam would act as an adhesive fixing the tile to the roof substrate. However, the expansion of the foam lifted the tile as the foam cured and it was believed that the strength of the adhesive bond had to be thoroughly investigated as well as formulations addressing the tile lifting before a commercial product could be offered. Through my employer at that time, Life Tile (a subsidiary of Boral Concrete Products), a number of polyurethane foam companies were contacted to determine if there was an interest in pursuing a joint test program utilizing polyurethane foam as a roof tile adhesive. One company, Poly-Foam Products, Inc. expressed an interest in the roof tile application and I worked with that company commencing in the spring of 1993 on a program which resulted in the development of a two-component, polyurethane roof tile adhesive as disclosed in U.S. Pat. No. 5,362,342, incorporated by reference herein. As is well known, two-component, polyurethane foam is significantly different from a one-component, polyurethane foam. For instance, the chemical reaction of the formulation in a two-component foam occurs when the "A" side (isocyanate) contacts the "B" side whereas a one-component, polyurethane foam undergoes a pre-polymerization reaction within the container and utilizes moisture to effect foaming or frothing as well as curing of the polyurethane. The formulations are markedly different and traditionally the foams, even when sold for the same application, have different characteristics. For example, the two-component foam generally will not expand to the extent of a one-component foam after it has initially foamed on mixing. On the other hand, because of the A/B reaction, a two-component foam will generally have a quicker tack time or shorter open time than a one-component foam. Chemical formulations of the foam, however, can significantly vary such characteristics. In any event, the two-component foam adhesive described in the '342 patent places an adhesive bead extending the length of the tile. While this placement pattern has been tested and approved by the Southern Building Code, Florida for use as a roof-tile adhesive, placing the foam in a bead running the length of the tile is an excessive use of adhesive foam resulting in a higher cost to the roofing contractor than what otherwise is required. Additionally, the two-component application requiring two separate pressurized containers of chemicals, is somewhat unwieldy for use in roofing residential dwellings, especially if the roof pitch is steep.

In late 1995, I began testing a one-component, polyurethane foam supplied by Insta-Foam, Inc. and developed an adhesive pattern to minimize the use of the foam as described in my U.S. Pat. No. 5,895,536. The '536 patent discloses placing two discrete foam deposits (approximately the diameter of a tennis ball) at diagonally opposing corners of the roof tile. As shown in all the embodiments of my patent, one deposit is placed at the leading edge corner of the tile between the roof substrate and the tile underside while the other foam deposit is placed at the trailing edge corner between the outside surface of the lower tile (which the upper tile overlaps) and the underside surface of the upper tile. While less adhesive is used in the system disclosed in the '536 patent when compared to the adhesive used in the system of the '342 patent, two separate deposits are required per tile and only one deposit per tile extends between the roof and tile. This placement fundamentally limits the adhesion ability of the roof system. However, the use of small paddy sizes addressed the issues of tile displacement resulting from expansion during curing at least to the extent that noticeable tile displacement did not occur if the adhesive was properly applied.

The above represents what is believed a chronological development of the utilization of polyurethane foam as a roof tile adhesive in the United States and this is believed consistent with approvals given by building code regulatory agencies of Dade County, Florida which has approved the use of polyurethane foam when placed in a pattern as described in the '342 and '536 patents.

B) Europe.

In Europe, polyurethane foam has long been used to secure roof tiles. For example, an especially fabricated roofing tile having recesses for receiving polyurethane foam is disclosed in UK patent application No. GB 2169329 A, published Jul. 9, 1986. The assignee's sister company has sold a general purpose, one-component, polyurethane foam for use in adhering roof tiles to roofs. A published application of a one-component foam sold in Europe is to place a bead adjacent the leading edge on the outside surface of one tile contacting the trailing edge of the underside surface of a higher tile. Another common application of polyurethane foam is to spray the foam from the inside of the building to fill any cracks between tiles as well as to secure the tiles to longitudinally extending rafters. It is believed that European companies, including assignee's sister company, have sold one-component foams for roofing applications since as early as 1988.

C) Adhesive Application.

Apart from polyurethane foams, special roof tile adhesives have been developed for securing roof tiles to the roof substrate. In particular, Ohio Sealants, Inc. has developed a roof tile adhesive marketed under its Pro Series® RT600 brand name which has been certified by Dade County for repair of existing roof tiles. Specifically, certified repairs require the removal or the lifting of an existing loose tile sufficient to enable the application of a minimum 1"×1" bead of adhesive to the existing mortar pad so that both the mortar pad and the under side of the tile are in contact with adhesive and in addition, a ⅜' thick by 2" long bead of adhesive must be applied to the head of the previous tile. Generally, specially formulated, one component, roof sealing adhesives are sold in caulk type containers which are suitable for repairing existing tiles as opposed to laying courses of tiles covering the entire roof.

SUMMARY OF THE INVENTION

Accordingly, it is a principal object of the present invention to provide a roof construction, preferably using a one-component, polyurethane froth, which deposits a single adhesive pattern per roof tile in a manner which increases the strength of the bond between tile and roof while using a minimal amount of adhesive.

This object, along with other features of the invention, is achieved in a method for applying roof tiles to a roof with one-component, polyurethane adhesive where each roof tile has opposing leading and trailing edges intersecting with opposing side edges, an underside surface adapted to face the roof and an outside surface adapted to face the elements when the tile is installed on the roof. The method includes the acts of dispensing, for each tile, the adhesive in an integral, U-shaped, sandwich pattern. The sandwich pattern has top and bottom adhesive leg deposits extending from the tile's leading edge a distance towards the trailing edge adjacent the tile's outside and underside surfaces, respectively, and a bight adhesive deposit adjacent to and extending away from the leading edge but integral with and connecting the top and bottom leg deposits. The method includes positioning an upper tile to partially overlie an immediately adjacent lower tile so that the upper tile's leading edge is adjacent the roof while the upper tile's trailing edge extends past the leading edge of an immediately adjacent lower tile whereby the U-shape pattern of the lower tile is sandwiched because i) its bottom leg deposit is in contact with the roof and the underside of the lower tile, ii) its top leg deposit is in contact with the outside surface of the lower tile and the underside surface of the upper tile and iii) its bight portion is in contact with the roof, the underside surface of the upper tile and the leading edge of the lower tile thereby establishing adhesive contact between the roof and both tiles at positions adjacent the leading and trailing edge of the tiles. The method includes covering the roof by laying tiles side by side while repeating the dispensing and positioning acts for each placed tile to form longitudinally extending tile courses, each course, with the exception of the lowest first course, overlying a lower tile course and each course, with the exception of the last, highest course, being overlaid by a higher course whereby, with the exception of the first and last courses, the tiles are secured to the roof by depositing a single, U-shaped sandwich pattern on each tile.

In accordance with another aspect of the invention, the U-shaped sandwich adhesive pattern may be formed in several different ways. In one embodiment, the U-shaped sandwich pattern is formed by continuously applying an integral bead of adhesive extending from the underside of any given tile, around the leading edge of the given tile and on the outside surface of the given tile.

In accordance with yet another embodiment of the invention, any given tile in the second and subsequent courses is initially laid so that its trailing edge overlies a lower tile with a portion of its trailing edge in contact with the U-shape adhesive pattern of the lower tile and the U-shape pattern for the given tile is then formed by continuously dispensing an integral bead of adhesive from the underside of the given tile, around the leading edge of the given tile and onto the outside surface of the tile or from the outside surface of the given tile about the leading edge of the given tile to the space between the underside of the given tile and the roof. Preferably, the leading edge of the given tile is lifted when the bottom leg of the adhesive U-shape sandwich pattern is dispensed.

In accordance with another embodiment, the integral, continuous U-shaped pattern is formed on any given tile for the second and subsequent tile courses in two steps by first dispensing a bead of adhesive comprising the bottom leg of the pattern onto the roof (or alternatively, on the tile underside) and dispensing, in a second step, a second bead onto the outer surface of the given tile, after the given tile has been laid over a lower tile so that its leading edge is in contact with the bottom leg adhesive deposit. Significantly, the second bead is dispensed past and beyond the leading edge of the given tile to insure formation of the bight portion of the U-shaped pattern before tack free or open time of the foam formulation has elapsed whereby the top, bottom and bight portions of the pattern are formed in an integral unitary pattern without visible knit lines and completely extending between tile and roof areas in sealing contact therewith.

In accordance with another aspect of the invention, a method for installing roof tiles onto a roof is provided. The roof tiles having opposing trailing and leading edges intersecting opposing side edges and underside and outside surfaces. The method includes the acts of a) dispensing a one-component, polyurethane froth in a U-shape pattern extending from the underside of any given tile around the leading edge of the given tile to the outside of the given tile and b) placing a tile in overlapping relationship to a lower tile whereby the adhesive on the underside of the given tile contacts the roof adjacent the leading edge of the given tile while the underside of the given tile adjacent the trailing edge contacts the adhesive pattern dispensed on a lower tile to establish sealing contact between the underside of a given tile adjacent its trailing edge with the outside of the lower tile and between the underside of the given tile adjacent its leading edge with the roof.

In accordance with another aspect of the invention, an improvement is provided for a roof having a substrate, an underlayment covering the substrate and a plurality of roof tiles adhesively affixed to the substrate. The improvement comprises each roof tile being affixed to the roof by a one-component adhesive applied to individual roof tiles of the plurality of roof tiles in a U-shape, continuous sandwich pattern, one pattern for each roof tile. The pattern includes a bottom leg adhesive deposit between the underside of any given roof tile and a roof substrate, a top leg adhesive deposit between the outside of the given tile and the underside of any overlying tile and a connecting bight adhesive deposit extending beyond the leading edge of the given tile and vertically extending between the underside of the overlying tile and the roof substrate.

It is a general object of the invention to provide a system, method and apparatus, for applying one-component adhesive, particularly a one-component polyurethane froth or foam, to secure roof tiles to a roof.

It is another object of the invention to provide a roof construction system for adhering roof tiles to a roof, particularly roofs for residential dwellings, which is an improvement over existing methods.

It is a particularly important object of the invention to provide a roof construction for adhesively securing roof tiles to a roof which has any one or more or any combination of the following features:

a) only one adhesive pattern per tile is required;

b) the adhesive pattern provides improved strength properties over other known methods of adhesive placement;

c) the adhesive pattern provides direct sealing contact from the tile to the roof at two different areas for each tile;

d) the adhesive deposit pattern uses a minimum amount of adhesive to cover any given roof;

e) the adhesive pattern, by its unitary, relatively large structure, is believed able to better distribute stresses attributed to differential thermal expansions between roof and tile;

f) the adhesive pattern system is easy or simple to apply;

g) the adhesive deposit system provides sufficient air flow/drainage between the tiles satisfactory to at least meet any known building code requirements; and/or, h) the adhesive deposit system allows for quick installation of the roof reducing overall roofing cost.

Another object of the invention is to provide a method for applying roof tiles to a roof which, while using no more adhesive than that of prior art two adhesive pad placement systems, produces not only a stronger, individual tile bond but also bonds both overlied and overlaid tiles to the roof in an interlocking adhesive pattern to increase the effectiveness of the adhesive bond for the entire roof.

These and other objects of the invention will become apparent to those skilled in the art upon reading and understanding the Detailed Description of the Invention set forth below taken in conjunction with the drawings.

BRIEF DESCRIPTION OF THE DRAWINGS

The invention may take form in certain parts and in an arrangement of certain parts taken together and in conjunction with the attached drawings which form a part of the invention using like reference numerals to refer to like parts and wherein.

DETAILED DESCRIPTION OF THE INVENTION

Figure 1:
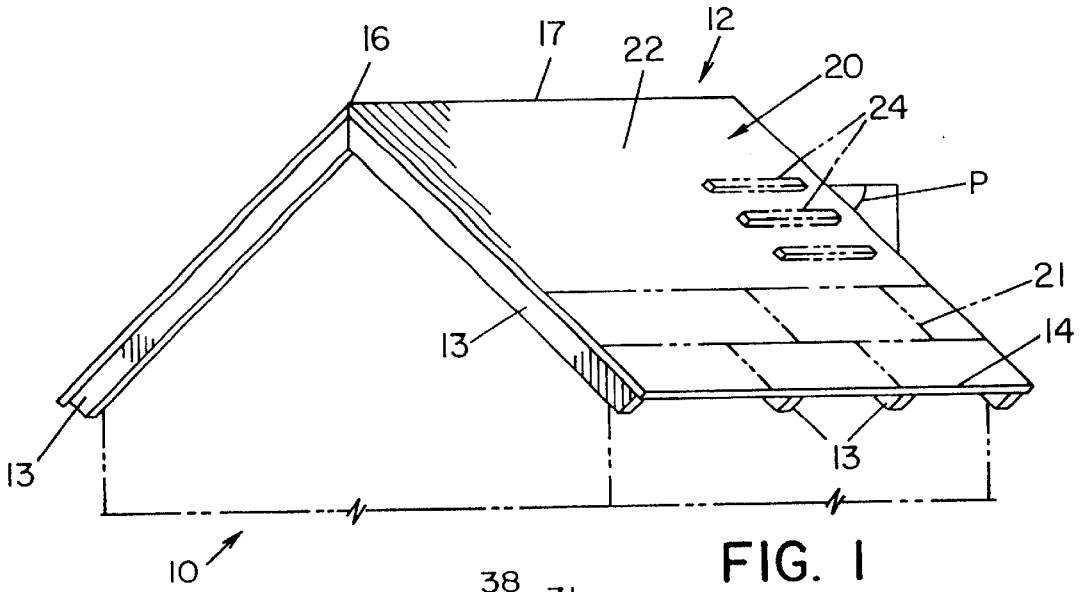
FIG. 1 illustrates a typical pitched roof upon which roof tiles are attached.

Referring now to the drawings wherein the showings are for the purpose of illustrating a preferred embodiment of the invention only and not for the purpose of limiting the same, there is shown in FIG. 1 a dwelling 10 having a roof 12 disposed thereon at a particular angle or pitch designated by the letter "P" in FIG. 1. Roof 12 is formed by a plurality of structural members orjoists 13 which are longitudinally spaced from one another and extend vertically upward from a lowest most edge or eave 14 of the roof at pitch "P" to a central ridge beam 16 at the roof apex 17 in a conventional manner.

Joists 13 support a roof substrate 20 which covers the roof. Roof substrate 20 is commonly formed of a multiple layer construction and typically includes a sheeting 21 or decking which may comprise plywood, particle board, cement boards, or the like and which are nailed or otherwise mechanically fastened to joists 13. Over sheeting 21 is an underlayment 22 or final covering or cap sheet which is typically a water resistant material such as roofing felt or tar paper. Underlayment 22 is typically fastened by mechanical connections to sheeting 21 and joists 13. Roof tiles are directly secured to underlayment 22 except if the pitch of the roof is steep, i.e., over a 7:12 pitch. In such instance, batten strips, shown in phantom in FIG. 1 and designated by reference numeral 24, which are vertically spaced and extend longitudinally along roof 12 are provided. When batten strips are used, the roof tiles are provided with anchor lugs on the underside of the tiles. The anchor lugs slip over and engage the upper edge surface of a batten strip 24. For convenience, "roof" as used herein and in the claims includes joist 13, sheeting 21, underlayment 22 and batten strips 24 if applicable and includes any construction extending over the walls of a building or dwelling to which roof tiles are secured. "Substrate" as used herein and in the claims and for convenience only means any arrangement of coverings or the like fixed to the joist 13 onto which the roof tiles are attached.

Figure 2:
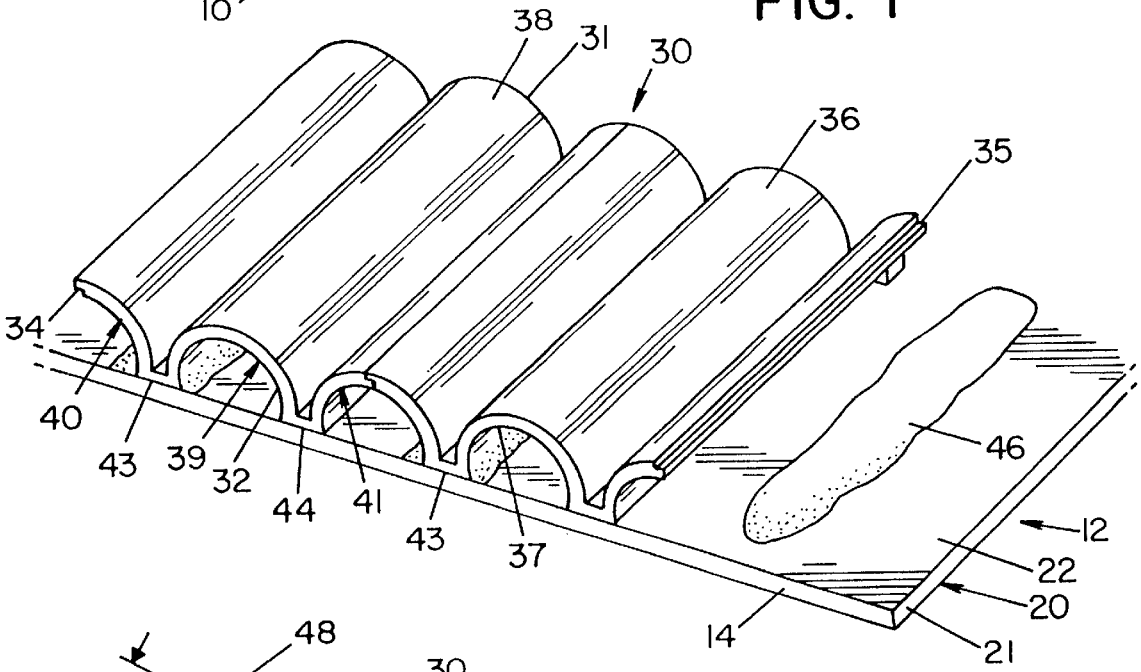
FIG. 2 (PRIOR ART)
FIG. 2 is a perspective view of a segment of a prior art roof construction utilizing a two-component adhesive foam to adhere a roof tile course to a roof substrate using continuous, linear beads of adhesive foam extending along the entire length of the roof tiles and represents the system described in the '342 patent.

Referring now to FIG. 2 there is shown a prior art roof construction which is typical of the construction described in U.S. Pat. No. 5,362,342. As described in the '342 patent and as shown in FIG. 2, the construction includes a plurality of medium/low profile roofing tiles 30. (Tile 30 shown in FIG. 2 has traditionally been referred to as a low profile tile and more recently as a medium profile tile. For consistency in terminology, it will be subsequently referred to herein and in the claims as a low profile tile.) Low profile tile 30 is generally rectangular (as are all the tiles) having opposing leading and trailing edges 31, 32 intersecting with opposing side edges 34, 35. (Leading edge 31 is commonly referred to as the "head" of the tile while trailing edge is commonly referred to as the "nose" or "tail" of the tile. "Leading" and "trailing" will be used throughout the Detailed Description and in the claims and when used with "edge" designate the edge surfaces as shown in the drawings.) Side edges 34, 35 designate the edge surfaces as shown in the drawings and have interlocking grooves adjacent thereto as shown or, depending on tile configuration, as a part thereof. In addition, low profile tile 30 has a non-planar outside surface 36 and a similarly formed non-planar underside surface 37. Non-planar surfaces 36, 37 are formed as a hollow central semi-circular portion 39 flanked by two hollow quarter portions 40, 41. The intersection of semi-circular portion 39 with one quarter portion 40 forms generally a flat contact underside rib 43 (i.e., tile pan section) while the intersection of semi-circular portion 39 and the other quarter portion 41 forms a second underside rib 44 (i.e., a tile pan). As shown in FIG. 2, underside ribs 43, 44 are positioned closely adjacent underlayment 22 of roof substrate 20. In accordance with the teachings of the '342 patent, a bead 46 of a two-component polyurethane foam is placed on underlayment 22 extending from leading edge 31 to trailing edge 32 to establish sealing contact between roof 12 and at least one of the underside ribs 43, 44. When roof tiles 30 are placed on foam bead 36 they are spaced from underlayment 22 by the bead to insure an air space between tile and roof. (A similar air space is formed by the pad of mortar typically used in conventional applications.) Bead 46 uses a fairly significant amount of polyurethane foam.

Figure 2A:
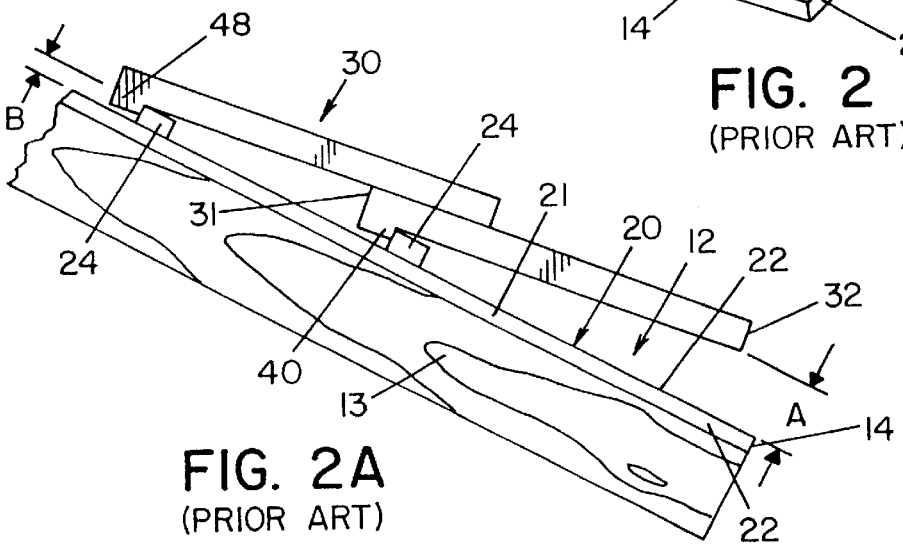
FIG. 2A (PRIOR ART)
FIG. 2A is a cross-sectional view of the system shown in FIG. 2 with the tiles having an anchor lug.

This is perhaps best illustrated by referring to a cross-sectional representation of a low profile roof tile 30 fitted with an anchor lug 48 as best shown in FIG. 2A. The effect of batten strip 24 is to vertically displace low profile tile 30 from underlayment 22 a distance at least equal to the height of batten strip 24. The two-component bead 46 must extend the distance represented by dimensions "A" at the trailing edge to the dimension "B" at the leading edge 31 of low profile tile 30. This can be in excess of 2" for conventional tiles having a length between leading and trailing edges 31, 32 of about 16". At the same time, it is to be recognized that anchor lug 48 and batten strip 24 take up space otherwise occupied by foam.

While a significant amount of adhesive is thus used, a more subtle point relates to the expansion of the foam. As noted in the Background, when a two-component foam is employed, the reaction of the two-components, as they are mixed together, produces the foam. Assuming that the dispensing gun mixes the components at the proper formulated ratio, the chemical will immediately expand within seconds after striking the roof. That is, a two-component foam will typically spray as a liquid onto underlayment 22 and within seconds bead up as a foam. The discussion of "expansion" herein refers to the continued growth of the foam after it has initially formed itself into a foam. As is well known, not all the isocyanate has reacted after the foam is formed. The reaction of the free isocyanate produces closed cells which result in continued expansion of the foam. The reaction continues not only during the open time or tack free time but also after a skin has formed at which time the foam is no longer capable of being used as an adhesive. Curing to a hardened state continues for some time after skinning and although some free isocyanate may react with moisture, the foam does not materially expand further. Thus, to some extent, a two-component foam is somewhat suited for the excessive foam application as shown in FIGS. 2 and 2A since low profile tiles 30 will not significantly move as the two-component foam cures to its hardened state. The "down side" to the two-component foam is that the tack free time or open time for a two-component foam is relatively short so that only a set number of tiles can be laid before the foam skins. In contrast, one-component foams use moisture from the air and the substrate to cause chemical reaction with the isocyanate.

A one-component foam will quickly expand to a froth or foam when exposed to atmosphere. In fact, the preferred one-component foam used in the invention is dispensed as a froth as it leaves the gun similar to how shaving cream is dispensed from an aerosol container. In contrast to typical two-component foams, typical one-component foams will likely expand more after the one-component urethane froths until the foam cures. While the expansion, as a percentage, is not significant, when a one-component foam was used in an excessive foam application such as disclosed in the '342 patent, the tiles could be lifted after they were laid. It is possible that if a one-component foam was used for the pattern disclosed in the '342 patent, that there could be varying expansions of the foam as it cured resulting in uneven tile displacement. If the tiles are displaced unevenly, the adhesive is unacceptable. On the other hand, the tack free or open time for a one-component foam is generally accepted as being longer than a two-component foam. Again, this discussion is predicated on generally accepted formulations of two-component and one-component foams. Special formulations can be had which vary the expansion characteristics of the foam, the adhesive characteristics of the foam, and the tack free time or open time of the foam whether the formulation relates to a one-component or to a two-component foam.

Figure 3:
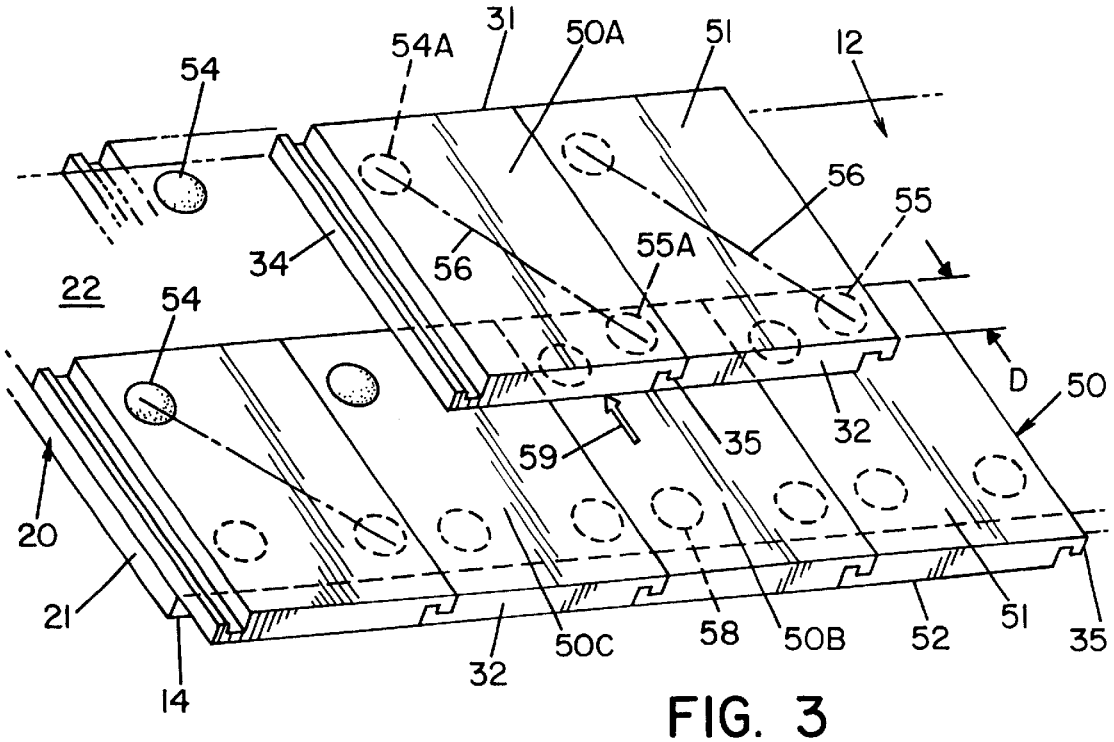
FIG. 3 (PRIOR ART)
FIG. 3 is a perspective view of a segment of a prior art roof construction utilizing an opposing comer one-component foam deposit representative of the system disclosed in the '536 patent.

Referring now to FIG. 3 there is shown a prior art roof construction which is typical of the construction illustrated in my '536 patent. The roof construction is illustrated for a flat tile 50 which, like low profile tile 30, has leading and trailing edges 31, 32, respectively which intersect with opposing side edges 34, 35. The tile shape adjacent side edges 34, 35 is grooved as shown to provide an interlocking engagement with adjacent tiles. Flat tile 50 has a planar outside surface 51 and a generally planar underside surface 52. Typically, underside surface 52 comprises a series of longitudinally extending ridges or ribs forming grooves therebetween (not shown) except for flat clay tiles which are smooth.

In the roof construction described in my '536 patent, a leading edge deposit of foam in the form of a leading edge pad or paddy 54 is deposited between roof underlayment 22 and underside surface 52 of any given flat tile 50. Specifically, leading edge paddy 54 is placed at a corner formed between leading edge 31 and one of the side margins 34 or 35. A second foam deposit in the form of a trailing edge pad or paddy 55 is placed between underside surface 52 of any given tile and outside surface 51 of an adjacent lower tile. Trailing edge paddy 55 is placed adjacent trailing edge 32 and an opposing side margin 34 or 35 but at the opposing comer to that occupied by leading edge paddy 54, so that leading edge paddy 54 and trailing edge paddy 55 lie on a diagonal. This is specifically shown in FIG. 3, by the leading edge paddy designated 54A provided for flat tile 50A. Paddy 54A extends between roof and tile 50A. A trailing edge paddy 55A is shown for roof tile 50A and the corner-to-corner diagonal is indicated by dot-dash line 56. Paddy 54A extends between tiles 50A and 50B. Tiles 50 are laid in longitudinally extending roof tile courses and the arrangement illustrated in FIG. 3 includes the lowermost or first roof tile course which overlies roof eave 14 and necessitates additional foam paddies 58 adjacent but spaced from trailing edge 32 of the first course tiles. Additionally, because of the eave overhang of the first course tiles, trailing edge paddy 55 has to be likewise spaced from trailing edge 32 of the tiles in the first roof course. Tiles in the second and subsequent courses (and until the last course at ridge beam 16) are laid so that the tiles trailing edge 32 always overlaps the underlying immediately lower tiles leading edge 31 to define an overlap designated by the dimension shown as "D" in FIG. 3. Paddies 54, 55 are sized to a dispensed area fitting within this overlap distance "D".

The roof construction of my '536 patent reduces the volume of polyurethane foam used to adhere the roof tiles to roof 12. A more subtle but critical result is that use of less foam results in the weight of the tile allowing the paddy to expand during cure without raising the roof tile. Simply put, less foam reduces the foam expansion force so that the weight of the tile can force the foam to expand or move into any free space under the tile without lifting the tile. It should be noted that in the roof construction shown for my prior art '536 patent, the tile is secured to roof 12 only by leading edge paddy 54. Trailing edge paddy 55 is adhesive connecting one tile to another. A wind force directed against the tile such as shown by reference numeral 59 in FIG. 3 is resisted by only one paddy. That is, the two paddies together provide an adhesive connection from the roof to the tile to an overlying tile and that connection is, as shown in FIG. 3, separated from each other. Thus, the strength of the bond is limited. This invention uses an entirely different placement pattern to produce a stronger bond with a one-component foam that does not adversely affect tile placement because of expansion of the foam.

Figure 3A:
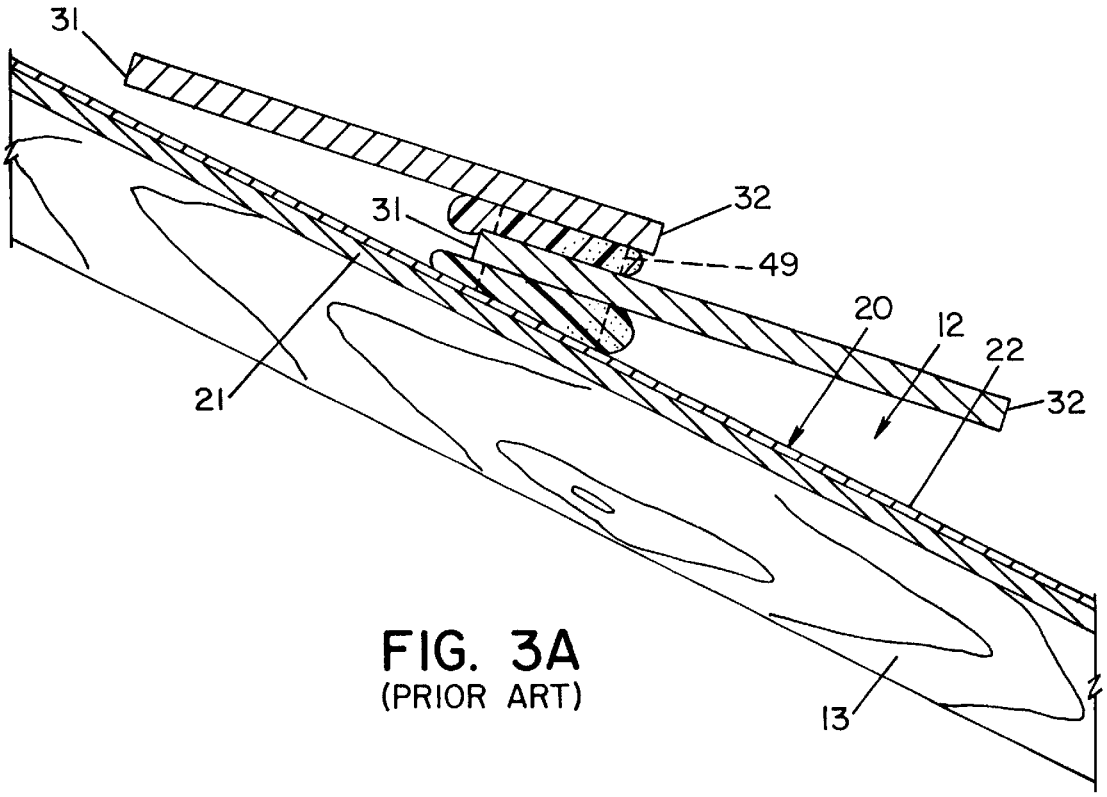
FIG. 3A (PRIOR ART)
FIG. 3A is a cross-sectioned view of the prior art based on a variation of the roof construction shown in FIG. 3 with the adhesive shown displaced from its dispensed position.

My '536 patent discloses that the paddies are placed in opposite corners at the undersides of the roof tile. When the tiles are installed onto the roof, and whether or not the tile courses are offset relative to one another, the paddies do not overly one another. Despite the teaching of the '536 patent to locate the paddies in opposite tile corners, roof installations have been observed where the paddies are located more towards the center of the tile so that the pad of one tile overlies the pad or at least a portion of the pad of an underlying tile when the overlying tile is pressed down into the lower tile. In most tiles, there is an anchor lug or ridges formed on the underside of the tile which directs or receives the adhesive displaced from the adhesive pad when the tile is pushed towards the roof to seat the tile. However, flat clay tiles traditionally have a flat smooth surface. When the tile is seated the vertical space between tile underside 37 and roof 12 near tile leading edge 31 and the vertical space between tile underside 37 and outside surface 36 of the overlaid tile near tile trailing edge 32 is reduced. I believe that for flat clay tiles, the foam in pads 54, 55 moves outwardly in all directions and pads 54, 55 increase in size. In my '536 patent pad shapes within the specified gram size limitations comprise a rectangular pad 2"×3" by 1" high and a circular foam of about 2½" by 1" high diameter. The areas covered by these pads, as dispensed, are 6 $in^2$ for the rectangular pad and about 5 $in^2$ for the circular pad. The pad heights are typically reduced from 1" to about ½" when the tiles are pushed into their laid set condition. The pads will typically expand in coverage to about 10 $in^2$. Thus, the diameter of the circular pad will increase to slightly over 3½" and the rectangular pad will increase to about 2⅝"× 3⅞". The overlap "D" varies by manufacturer but is generally about 3". (Overlap "D" varies by tile type and code, typically from a minimum of about 2" to a maximum of about 4". Tile sizes vary significantly. Nominally, tiles have a width of about 9–10" and a length of about 14–18". However, these ranges could be significantly expanded both at the high end and the low end. European tiles are significantly smaller. Certain cement tiles are significantly larger.) The rectangular pad in its flattened state will generally stay within the overlap. A portion of the circumference of the round pad will extend beyond the leading edge 31 of the overlaid tile. This is illustrated in FIG. 3A where dash lines 49 indicate the general position occupied by pads 54, 55 when dispensed. The pads are drawn in their flattened, displaced condition and when they are applied, not at the comers, but at the center portions of the tile. A circumferential portion of each pad 54, 55 extends beyond the leading edge 31 of the overlaid tile but the foam does not extend between the pads. Unless the pad size is significantly increased, foam extending past leading edge 31 does not establish contact between roof 12 and underside surface 37 of the overlying tile. Further, even if the pads were significantly oversized, and misplaced to somehow establish contact, the tiles are normally laid in a course progression. The tack free time of leading edge pad 54 may have lapsed when the overlying tile is placed over a tile establishing visible knit lines (non-adhesion between the two foams) between the foam of the two oversized pads.

It should also be noted that I have often observed tile applications with mortar. In those applications where the mortar pad is sometimes haphazardly placed towards the upper center of the tile, the mortar can also be displaced beyond leading edge 31 when the tile is pressed down into the mortar. However, bonding by the mortar between the higher tile and roof is not believed to occur significantly. In a mortar application, there is also no bonding between the tiles. Mortar is usually not placed between tiles except to seal the exposed edges at the ends of the tile courses, i.e., rake.

My observations of how I believe the foam and mortar is being displaced when a flat tile is pushed into the roof to set the tile in place, is utilized, in part, to form one of the underpinnings of my present invention.

Figure 4:
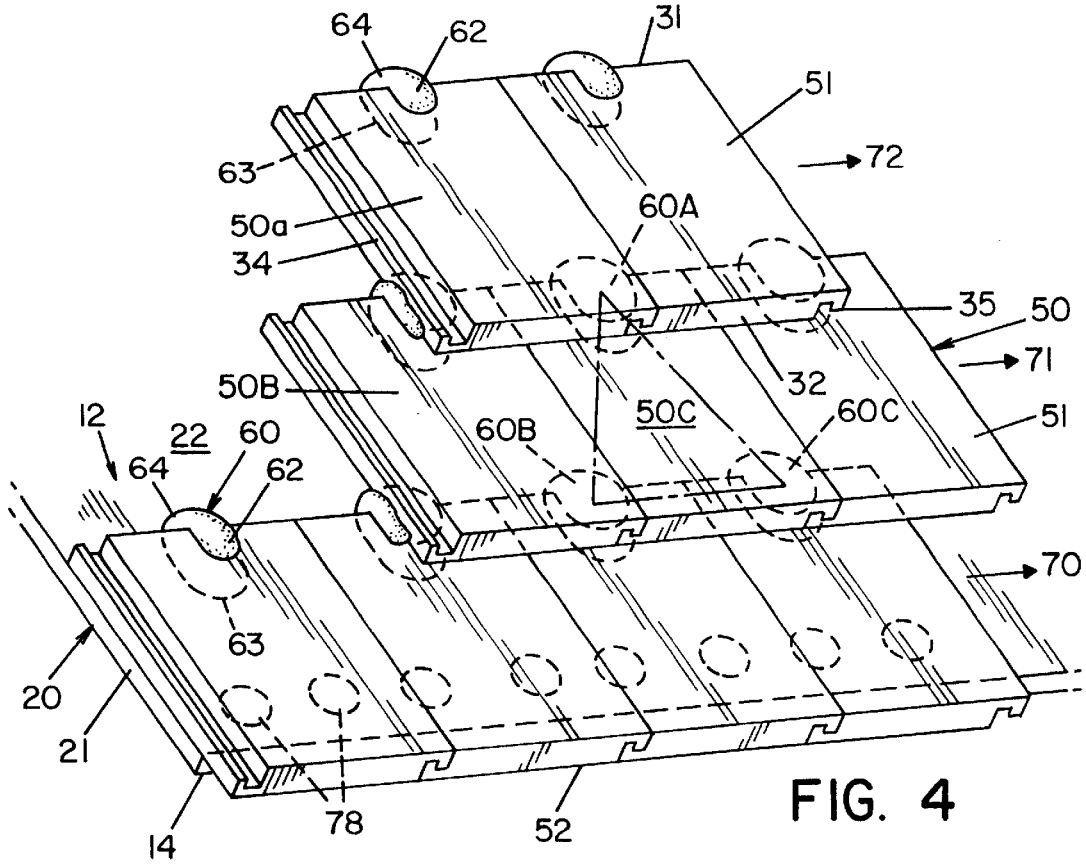
FIG. 4 is a perspective view of a section of a roof illustrated by a placement of three courses of flat roof tiles installed thereon using the present invention.
Figure 5:
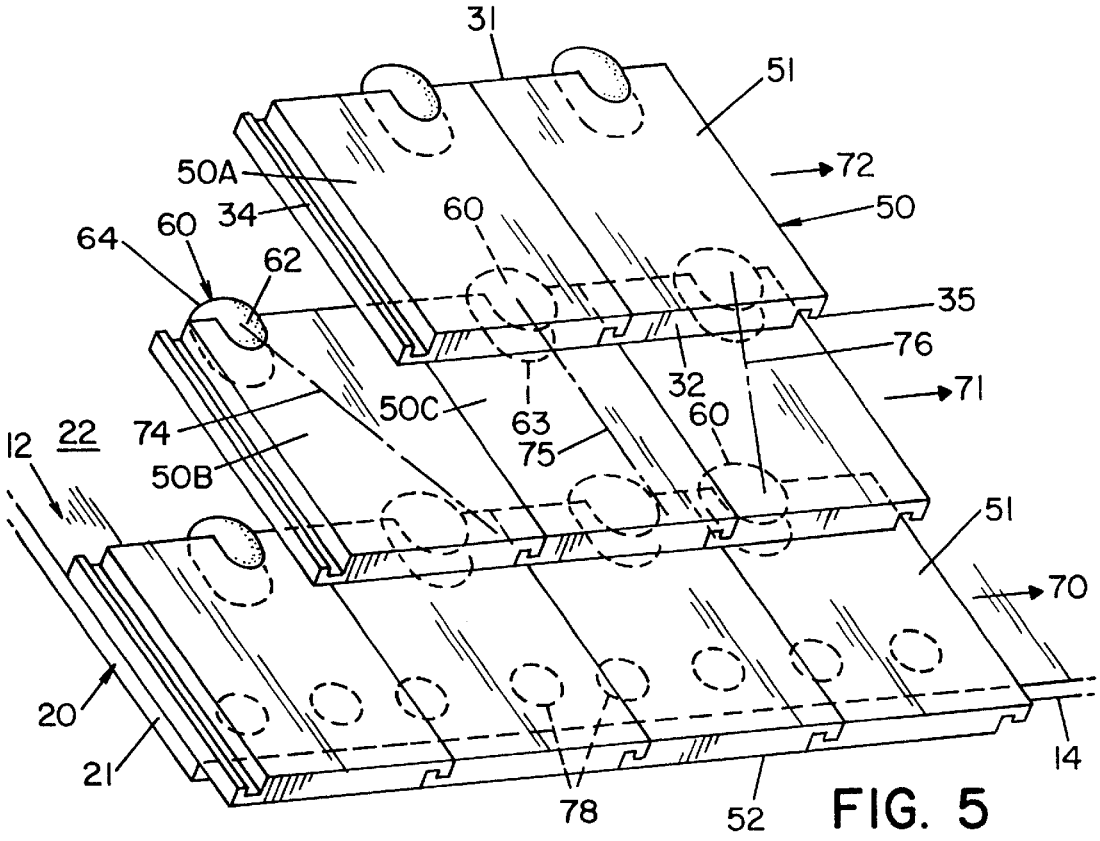
FIG. 5 is a perspective view similar to FIG. 4 illustrating an alternative embodiment of the invention as applied to flat roof tiles.
Figure 5A:
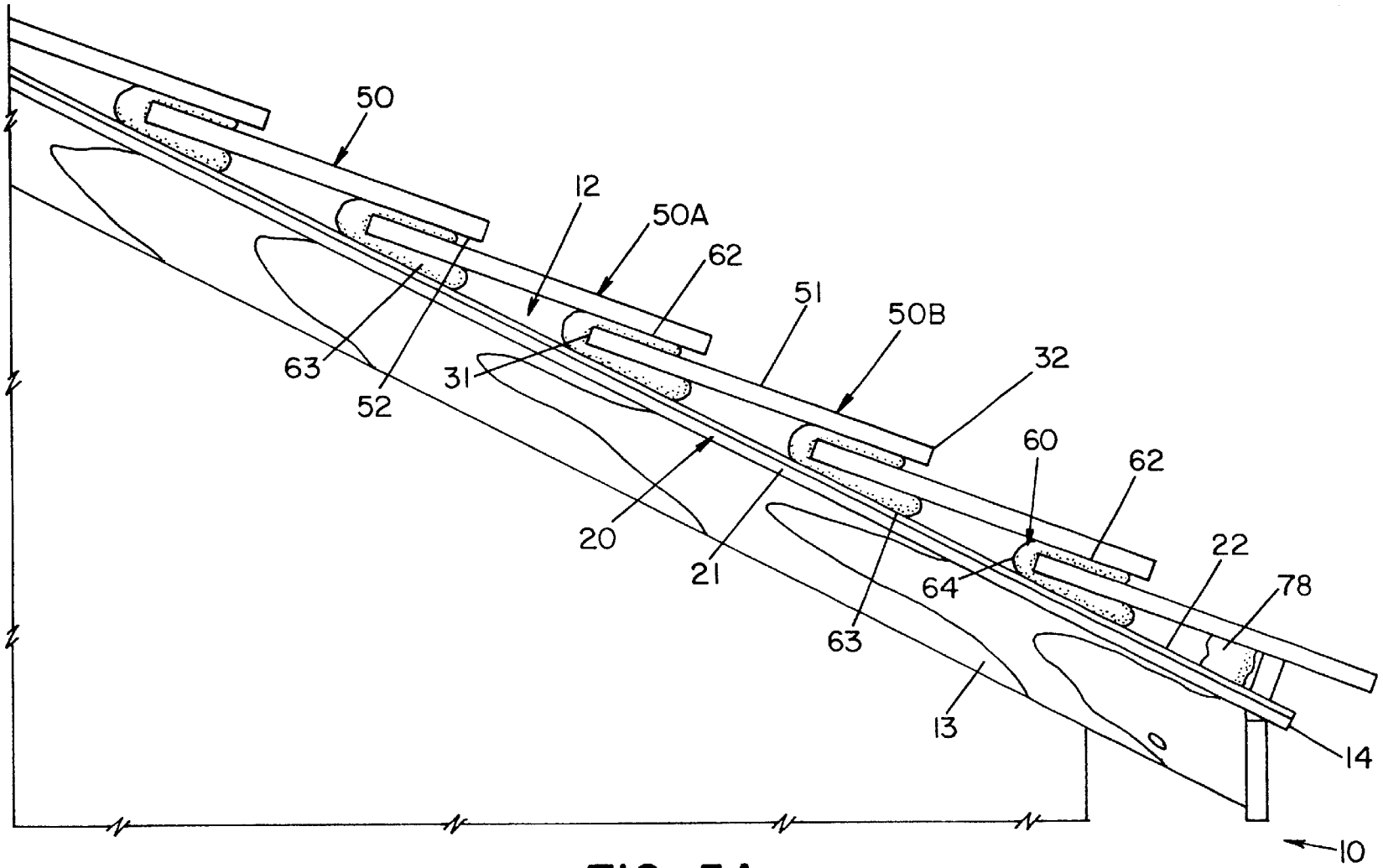
FIG. 5A is a cross-sectional view of the flat tile application shown in FIGS. 4 or 5.

Referring now to FIGS. 4, 5 and 5A, there is shown the roof construction of the present invention applied to flat tiles 50. The roofing construction includes a U-shaped pattern 60 of polyurethane adhesive purposely dispensed as a "U" form extending about leading edge 31 of a tile such that when the tiles are placed in position, the U-shaped pattern 60 is sandwiched between roof, tile and overlying tile. U-shaped pattern 60 comprises a top leg deposit 62, a bottom leg deposit 63 and a bight deposit 64 interconnecting top and bottom leg deposit 62, 63 into a unitary, integral pattern. When the tiles are pushed into position U-shaped pattern 60 increases in areas to establish sealing contact and adherence of the tiles to the roof when the polyurethane cures. Significantly bight deposit 64 may dimensionally increase more than top and bottom deposits 62, 63 since bight deposit 64 may receive adhesive therefrom as described with reference to the prior art. This assures that bonding occurs between the underside surface of the overlying tile and the roof.

While in accordance with the broader aspects of the invention, U-shaped pattern 60 could comprise any number of adhesive compositions (including a two-component polyurethane foam), it is a specific inventive feature of the construction to form a unitary, contiguous U-shaped pattern with a one-component polyurethane and specifically a one-component polyurethane froth. In the preferred embodiment, the adhesive pattern is formed from assignee's one-component polyurethane froth sold under the brand name Handi-Stick® Roof Tile Adhesive. However, a number of one-component polyurethane foams can be used. For example, a foam sold under the brand name Tile Bond® manufactured by Insta-Foam Products, Inc. may be used. The preferred one-component polyurethane foam or froth used in the present invention is classified as a low density, (typically closed cell) adhesive foam having minimum expansion characteristics. Some specific discussion of typical characteristics of one-component and two-component foams will be helpful in understanding the present invention. A high density foam is typically understood as a foam that has a density greater than 4 lbs/ft$^2$ when it is dispensed as a foam in a free, unrestrained state. In the present invention a one-component, low density foam having a density in the range of anywhere from 0.8 to 4.0 lbs/ft$^2$ and preferably in the range of 1.1 to 2.5 lbs/ft$^2$ is used. When a tile is pressed down, the foam in U-shaped pattern 60 (during the open time) will laterally displace itself to an open area (i.e., squish) although at some discrete pin head area, it may be restrained and increase in density at that area perhaps 1 lb/ft$^2$. Overall, the density of the foam will not increase when the tile is pressed down. U-shaped pattern 60 has a weight of anywhere from about 9 to 15 grams and preferably from 12–14 grams. This weight is believed about equal to that used in the 2 paddy prior art system disclosed in the '536 patent. Alternatively stated the surface area of a roof tile is about 1.2 sq. ft. and after the tiles have been assembled in overlying position and pushed down into the foam, the surface area of the tile occupied by U-shaped pattern is about 9 to 12 in$^2$ and preferably about 10 in$^2$. U-shaped pattern 60 when dispensed as a continuous bead and before being pressed by the tile occupies a tile (to roof) area of about 6 in$^2$. The density of the foam has application to the system not only as a measure of how much foam is used to secure the roof tile to the roof but also as to the vertical spacing between the tile and roof. Obviously, a high density foam will not displace under the weight of the tile to the extent of a low density foam and will not give the same surface area contact.

However, the expansion of a one-component foam, after it has been initially dispensed to assume its free standing state continues to expand as the free isocyanate continues to react with moisture until the foam is completely cured. The expansion of the one-component foam after the foam has been dispensed and assumes its free standing state (almost immediately but not more than 2–3 seconds after dispensing) is no more than 50% and preferably no more than about 20% of its free standing volume. In summary, a preferred low density foam (as defined) dispensed in the pattern (as defined) and having desired expansion characteristics (as defined) will provide desired tile to roof spacing having desired bond strength without causing tiles to become uneven after the foam has cured.

While the inventive system could be applied if the adhesive is a two-component polyurethane foam, there are further advantages to a one-component foam relating to the application of the system of the present invention. Because a one-component foam is moisture cured, the roofing application can start in early morning when dew or moisture is on the roof. The installer does not have to wait until the moisture is evaporated as in a two-component application. The open time or tack free time for a one-component application is significantly longer than for a two-component application. The open time for the Handi-Stick, one-component adhesive is about 4–5 minutes while the open time for a two-component foam is about 30 to 45 seconds. (These time, of course, assume "normal" or "ambient" temperatures and humidity.) As will be noted, Handi-Stick is dispensed as a froth which makes it desirable, (not however necessary) to continuously dispense U-shaped pattern 60 as an integral, unitary pattern whereas other one-component foams may bead only after impact with an object. (To avoid confusion in terminology, "foam" when used herein includes froth as well as foam whether produced by one-component or two-component polyurethane adhesives. "Froth" means froth—a foam formed as it leaves the nozzle in distinction to chemical reactions forming a foam after the chemicals leave the gun such as when they strike the roof or tile.) The cure time or the time to bond the tile to the roof for a one-component foam is about 2 to 4 hours while the cure time for a two-component foam is typically ½ to 1 hour. The time of course to "chemically" cure the foam is typically considered to be 24 to 48 hours although, technically, the time to completely react all the isocyanate may continue for a much longer time. However, it is believed desirable for roofing applications to have the longer tack free time before skinning of the one-component foam occurs so that U-shaped pattern 60 can be formed as an integral structure. While the longer cure time for a one-component foam may be viewed, initially as a detriment, in practice there is no detriment because the roof is laid from eave upward so the installer is not walking on the tiles after they have been laid.

Figure 11:
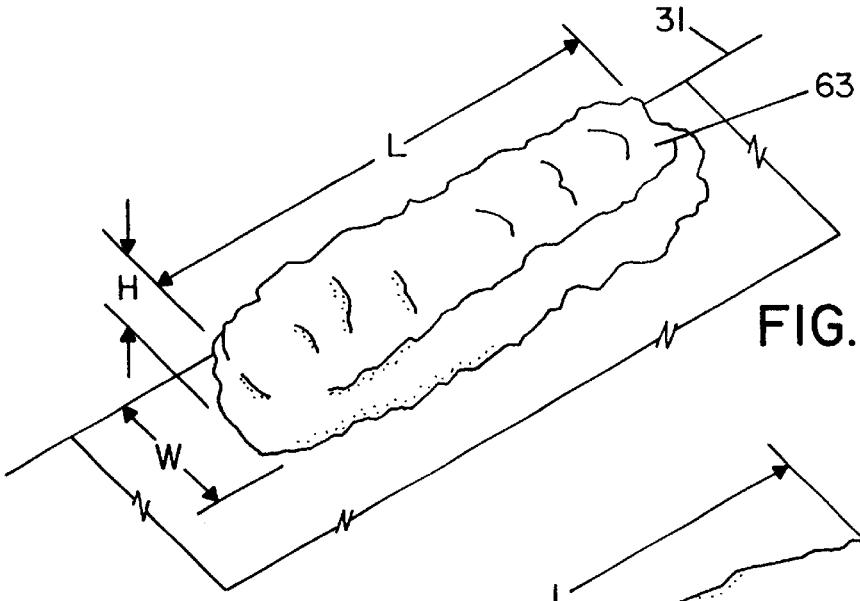
FIGS. 11 and 11A are perspective views showing different shapes of an adhesive deposit making up a portion of the adhesive pattern used in the present invention; and, FIGS. 12 and 12A are schematic representations of a tile test.
Figure 11A:
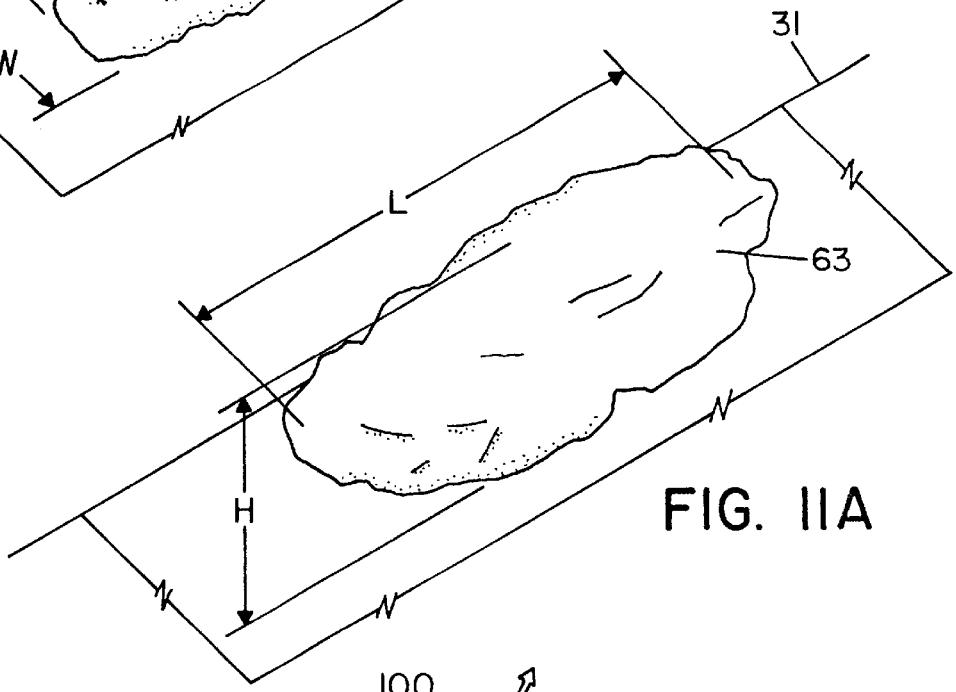

As best shown in FIG. 5A, when tiles 50 are positioned onto roof substrate 20, U-shaped pattern 60 becomes sandwiched between tiles and the roof. Specifically, top leg deposit 62 is in sealing contact with outside surface 51 of a lower tile 50B and the underside surface 52 of an immediately adjacent higher tile 50A. The sealing contact extends substantially the distance of overlap D from leading edge 31 towards trailing edge 32 of lower tile 50B. Bottom leg deposit 63 is in sealing contact with roof substrate and the underside 52 of lower tile 50B from leading edge 31 towards trailing edge 32. If the adhesive deposit stopped here, there could be some resemblance to the FIG. 3 prior art in that top leg deposit 62 contacts two adjacent tiles similar to prior art trailing edge paddy 55 and bottom leg deposit 63 contacts tile and roof similar to prior art leading edge paddy 54 except that leg deposits 62, 63 overlie one another (and by definition extend a slightly longer distance in that they begin from leading edge 31 and are not proximate to the leading edge). Significantly, bight deposit 64 is in sealing contact with roof substrate 20 and underside surface 52 of higher tile 50A. This is an additional roof contact extending from and wrapping about leading edge 31 not present in the prior art and contiguous with top and bottom leg deposits 62, 63. Also, significantly, bight deposit 63 is tying the tile-to-tile sealing contact into the roof-to-tile sealing contact increasing the overall strength of the bond. That is, U-shaped adhesive pattern 60 is bonding underside surfaces 51 of both tiles 50A, 50B to roof 12 while also tying the two tiles together. Generally speaking, top and bottom deposits 62, 63 overlie one another, but in application, they may be slightly skewed depending on how the froth is dispensed. It is preferred that bottom leg deposit 63 extend longitudinally further towards trailing edge 32 than top leg deposit 62 although the invention will function with equal length leg deposits. Preferably, leg deposits 62, 63 are in the form of an elongated rectangular bead, or alternatively, can be in the form of an oval bead as shown in FIGS. 11 and 11A. FIG. 11 shows top leg deposit 63, preferably having a width dimension "W" of about 4" to 4½" (extending between opposing side edges 34, 35), a length dimension "L" of about 1½" to 1¾" (extending from leading to trailing edges 31, 32) and a height dimension "H" shown in FIG. 11A of about 1" to 1¼". Preferably, the "W" dimension of bottom leg deposit 64 will be 1 to 1.25 times the "W" dimension of top leg deposit 63 to provide increased resistance to wind lift. Bight deposit 64 will have the same width as top deposit 62 (or bottom deposit 63) and a height equal to twice the height "H" of top deposit 62 (or bottom deposit 63) plus the thickness of the tile. The length of bight deposit 64 will be at least equal to the height of top deposit 62 (or bottom deposit 63). Top and bottom leg deposits 62, 63 can be formed elliptical as shown in FIG. 11A (width of about 3½ and length of about 2½) provided that the width edge of the ellipse completely extends to leading edge 31 so that bight portion can be formed throughout the length of the ellipse. All dimensions are given in dispensed form. Other dispensed shapes may be used.

When the tiles are placed onto the dispensed froth, before the froth reaches its tack condition, the low density foam will be reduced to about ¾ its height. The froth will spread to other areas including spreading into bight portion 64 from top and bottom deposits 62, 63. However, froth dispensed in bight portion 64 will always spread increasing bight portion 64 size and bonding area when the tile is initially positioned. When the tile is pushed towards the roof to establish the final tile position further dispensing the foam will result typically reducing its height to about ½ of its dispensed height. The bond in all instances is unitary.

Again, what the U-shaped pattern is accomplishing with a minimal usage of foam, is to provide (when compared to my prior invention) an increased roof-to-tile contact area while directly tying the overlaying and the overlaid tiles into the roof as well as tying the tiles together. Additionally, because of the relatively large area contact of U-shaped adhesive pattern 60 in a unitary structure, it is believed that the adhesive will be better able to distribute the stresses resulting from differential temperature expansion between roof tiles and roof substrate.

Referring still to FIGS. 4 and 5, there is shown a portion of tile coverage including a portion of a first or lower most tile course 70, a portion of a second tile course 71 overlying first tile course 70 and a portion of a third tile course 72 overlying second tile course 71. In FIG. 4, the tiles in each tile course are longitudinally shifted a distance approximately equal to ½ the distance between tile side edges 34, 35 relative to the tile positions of the immediately adjacent upper and lower tile courses. For flat tiles 50, this pattern of laying the tiles is generally recommended by the tile manufacturers. In the tile offset pattern position illustrated in FIG. 4, U-shaped adhesive pattern 60 may be optionally placed about the mid-point of leading edge 31. In this arrangement, it is possible by using only one U-shaped pattern 60 per tile to establish for each separate tile a three position sealing contact with roof 12. For example, flat tile designated 50C has contact with the roof by adhesive pattern designated 60A as described above. In addition, contact with the roof is also established by adhesive patterns designated as reference numerals 60B and 60C. Three tile to roof adhesions or bonds are thus made.

However, it must be clear that the invention is not necessarily limited to a particular placement of U-shaped adhesive pattern 60 in a specific position about leading edge 31 of any given tile. In fact, U-shaped adhesive pattern 60 can be placed anywhere along and about leading edge 31 and several different positions are illustrated in FIG. 5. Improved bonding will occur no matter where the U-shaped pattern is dispensed along leading edge 31. In FIG. 5, tiles 50 are not offset and tile courses 70, 71, 21 are vertically aligned with one another as shown. U-shaped adhesive pattern 60 can be placed at various positions along and about leading edge 31 as shown by dot-dash centerlines designated by reference numerals 74, 75 and 76 extending between U-shaped adhesive patterns of upper and lower tiles. It should also be noted that for the first or eave tile course 70, two lower pads of adhesive 78 are placed adjacent to but spaced from trailing edge 32 of tiles 50 in first tile course 70. Two pad deposits 78 are preferred.

Figure 6:
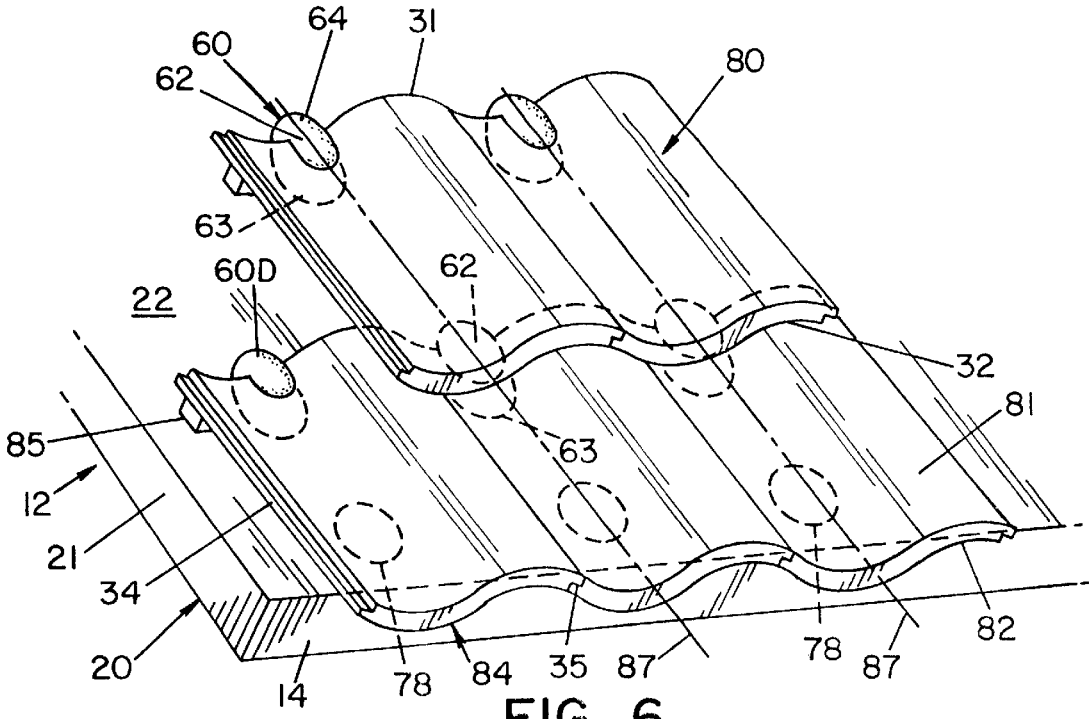
FIG. 6 is a view similar to FIG. 4 but showing the system of the present invention applied with high profile, non-planar roof tiles.
Figure 6A:
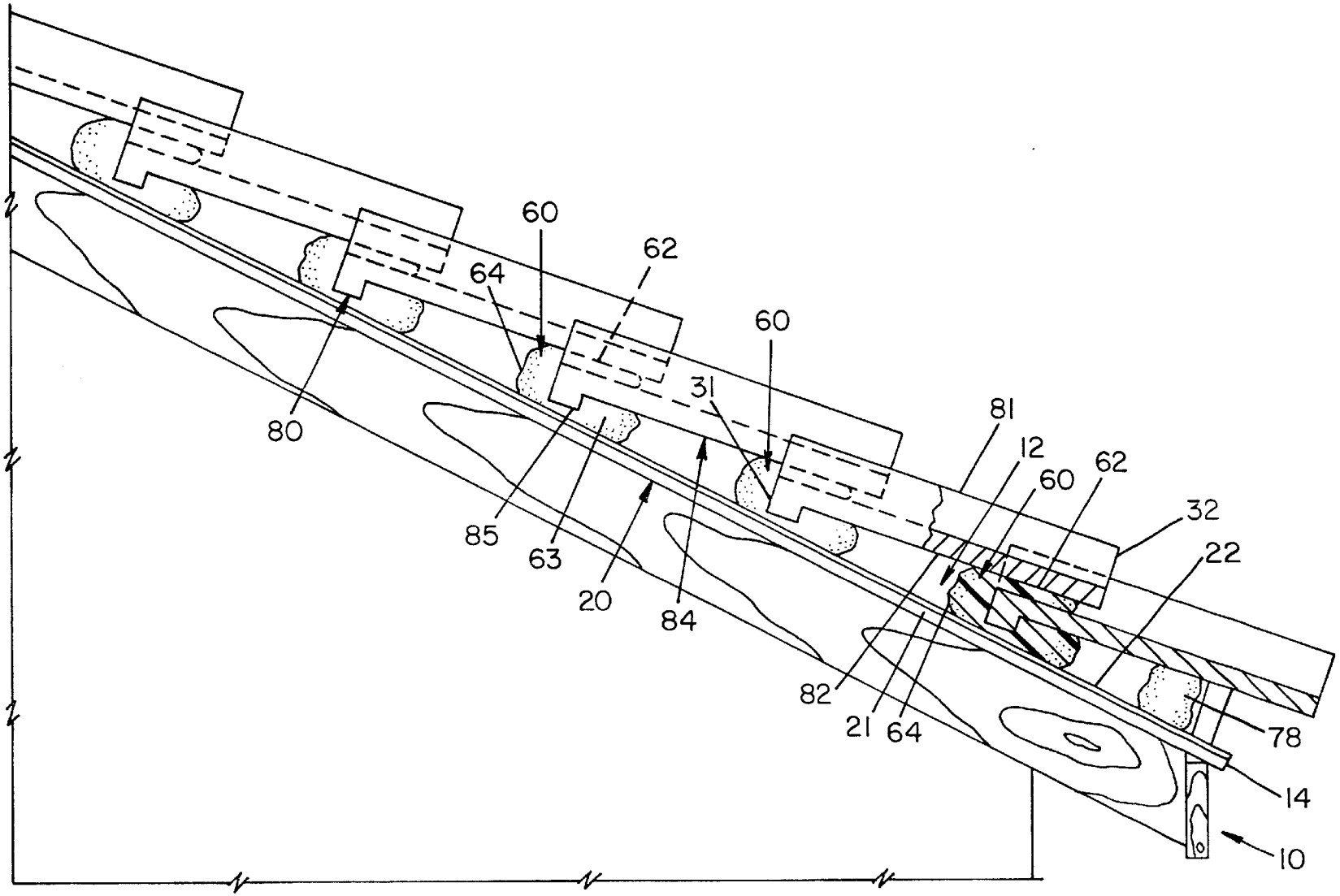
FIG. 6A is a cross-sectional view of the high profile tiles shown in FIG. 6.

Referring now to FIGS. 6 and 6A there is shown an application of U-shaped adhesive pattern 60 of the present invention to a high profile tile 80. High profile tiles have a non-planar outside surface 81 and a non-planar underside surface 82 which in cross-section somewhat assumes a "S" configuration as shown for diagrammatic purposes but in practice is more in the shape of a flat converted to a semi-circular or barrel portion. The portion of the "S" which contacts underlayment 22 is referred to as a pan section 84 of high profile tile 80. U-shaped adhesive pattern 60 must be placed in the pan section. Further, most high profile tiles 80 are provided with an anchor lug 85 in its pan section adjacent leading edge 31. Typically, anchor lug 85 for high profile tile 80 has a depth of about ⅝" to ¾" and batten strips 24 are ⅝" thick. Adhesive pattern 60 as shown somewhat by adhesive pattern 60D in FIG. 6, and more particularly, by bottom leg deposits 63 in FIG. 6A, extend about and around anchor lug 85 and batten strip 24 (if used). Further, high profile tiles 80 are laid in tile courses which are not longitudinally offset and resemble the pattern disclosed in FIG. 5. Thus, adhesive deposits 60 as shown in FIG. 6 are positioned in alignment with vertically extending centerlines designated by reference numeral 87 which align with side edges 34, 35. U-shaped adhesive pattern 60 comprises the same bead deposits and functions in the same manner for high profile tile 80 as it does for flat tile 50 as explained with reference to FIGS. 4, 5 and 5A.

Figure 7:
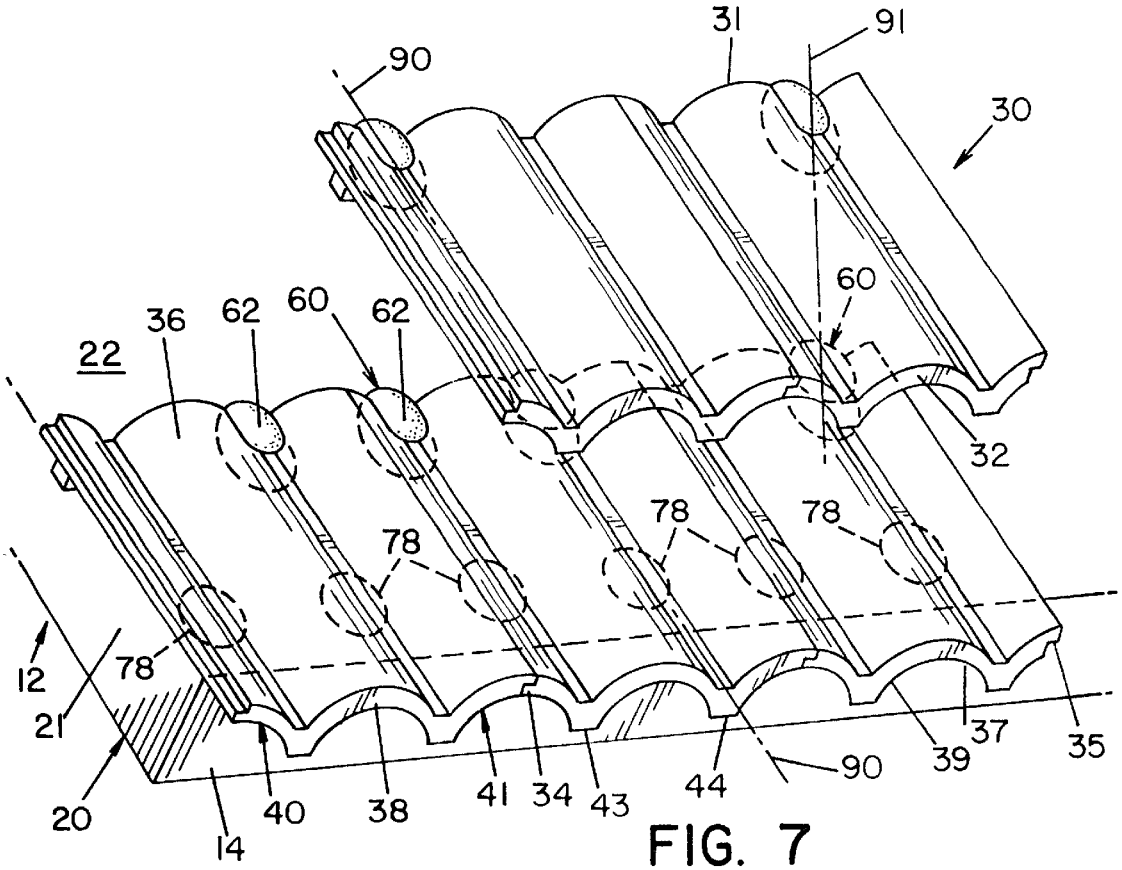
FIG. 7 is a view of a roof section similar to FIG. 3 for showing the system of the present invention applied to a medium/low profile roof tile.
Figure 7A:
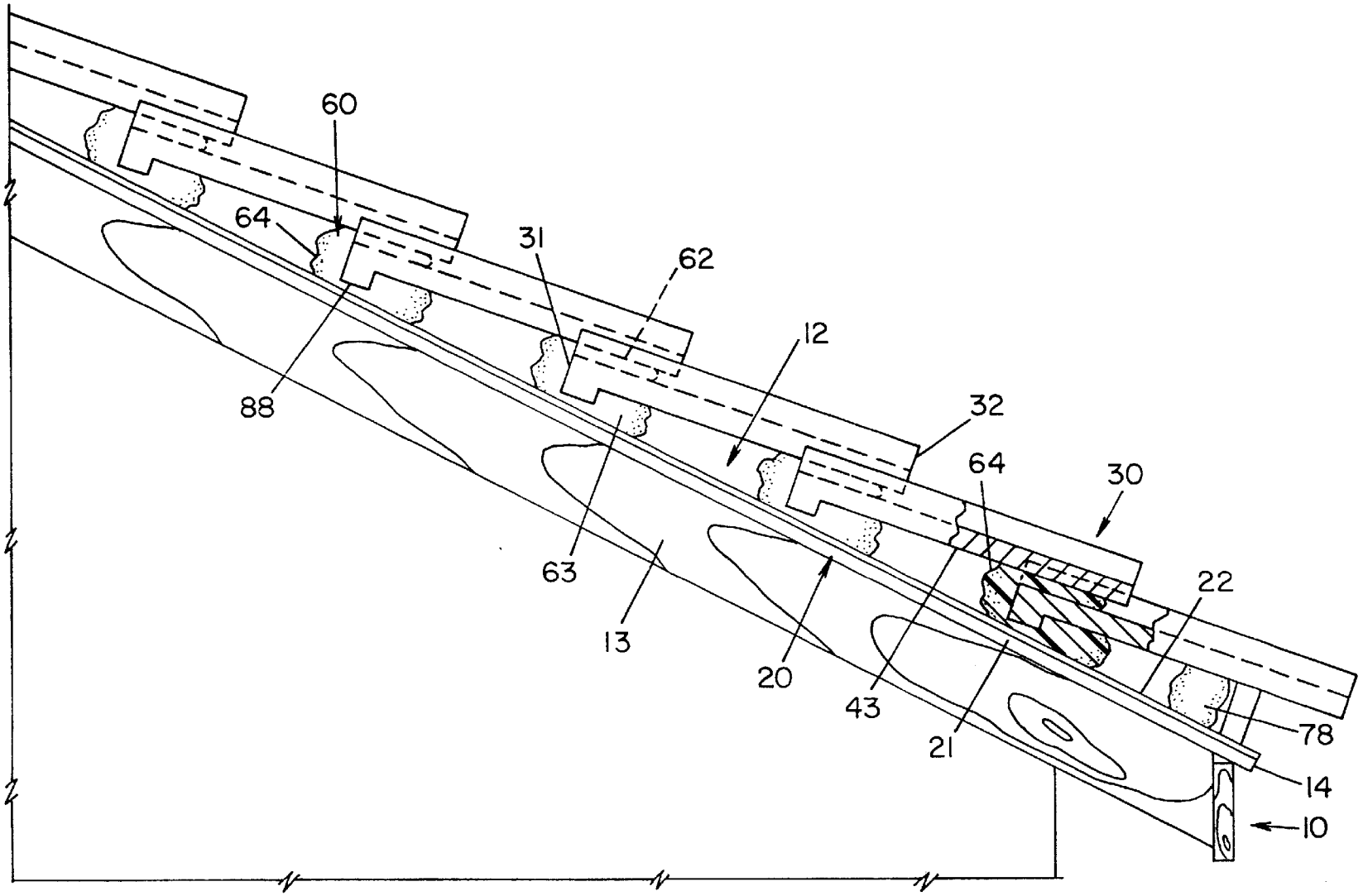
FIG. 7A is a cross-sectional view of the medium/low profile tile shown in FIG. 7.

Referring now to FIGS. 7 and 7A, the roofing construction of the present invention is applied to low profile tiles 30. Low profile tiles 30 are typically provided with an anchor lug 88, best shown in FIG. 7A, at each underside rib or pan section 43, 44 adjacent leading edge 31 and typically having a depth of about ½". As with high profile tile 80, adhesive U-shaped pattern 60 must be applied to each low profile tile 30 at one of its underside rib or pan sections 43, 44 (conceptually adhesive pattern could be applied to both) and about leading edge 31. U-shaped adhesive pattern 60 can be applied in a pattern where U-shaped adhesive deposits formed on higher and lower tiles are vertically aligned with one another such as shown by centerline 90 in FIG. 7 or are vertically offset to extend on a diagonal such as shown by centerline 91 in FIG. 7.

Figure 9:
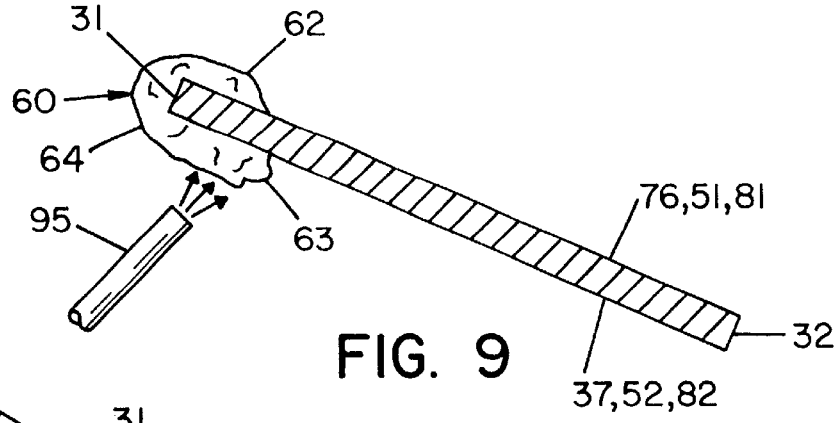
FIG. 9 is another view showing how the sandwiched pattern can be applied to a roof tile.

There are several ways in which adhesive pattern 60 can be dispensed in the desired sandwiched configuration. Perhaps the simplest way to dispense U-shaped adhesive pattern 60 is diagrammatically illustrated in FIG. 9. In FIG. 9, a dispensing nozzle 95 of a gun (or valve of a pressurized container) continuously dispenses a foam bead from the tile's outside surface 36, 51 or 81 to the tile's underside surface 37, 52, or 82 or from the underside to the outside of the tile. This method of forming the adhesive is particularly applicable for use with assignee's one component Handi-Stick adhesive which produces a froth immediately upon expelling the adhesive from the gun nozzle. Thus, a froth having a shaving lather consistency is dispensed from the gun nozzle. It can therefore be applied by resting the tile on its trailing edge 32 and dispensing a bead about leading edge 31, after which the tile is simply positioned in place. This type of application could not be easily accomplished with a two component adhesive.

Figure 8:
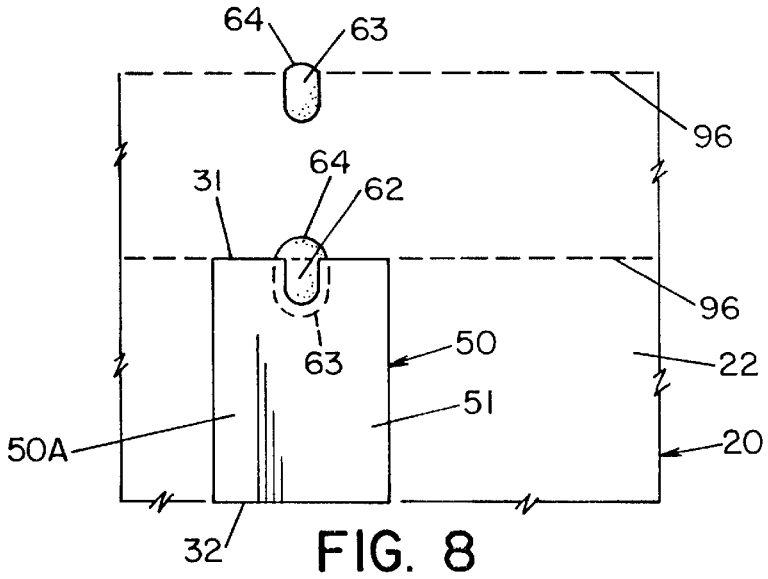
FIGS. 8, 8A and 8B are planar views showing one way of how the adhesive sandwiched pattern is developed during placement of the tiles.
Figure 8A:
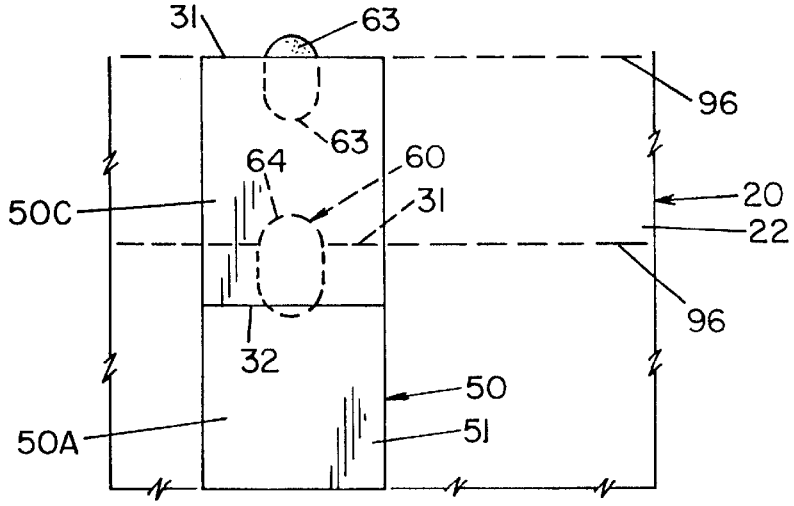
Figure 8B:
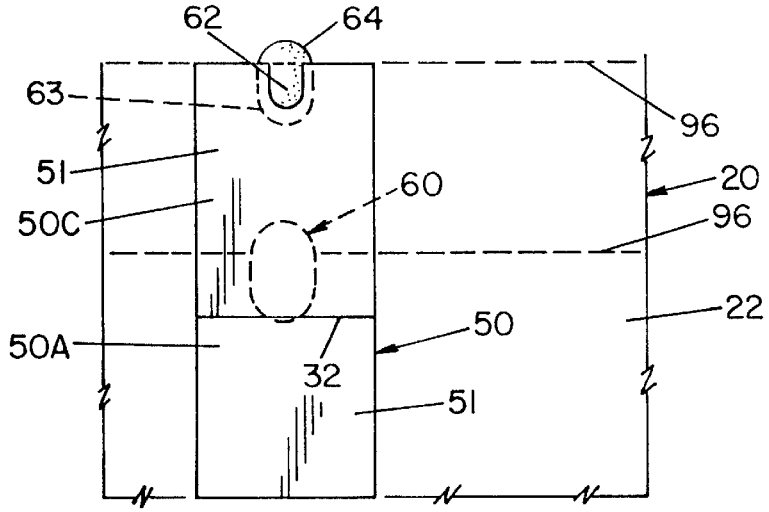

A more systemic approach is illustrated in FIGS. 8, 8A and 8B. In FIG. 8, bottom leg deposit 63 is laid on underlayment 22 extending a desired distance from a tile chalk line 96 (and extending beyond the chalk line to start forming bight portion 64). Alternatively, bottom leg deposit 63 can simply be applied as a bead to the underside of the tile. In FIG. 8A, a tile, for example flat tile 50C, is laid in position relative to chalk line 96 so that it overlies a lower tile shown as 50A. When tile 50C is laid on underlayment 22, bottom leg deposit 63 spreads out as it flattens and extends past chalk line 96. In FIG. 8B, a second bead is now dispensed on outside surface 51 of tile 50C. The slight portion of bottom leg deposit 63 extending beyond chalk line 96 serves as a guide to insure that the top bead overlies bottom leg deposit 63. This bead of adhesive as it is deposited, forms top leg deposit 62. Importantly, the froth deposit application continues past chalk line 96 to form contiguous bight deposit 64. Because a one-component foam is used and the U-shaped pattern 60 is formed well within the open time period, the foam continuing to be dispensed after the top bead is formed is able to flow into, meld and fuse with bottom leg deposit 63 and without forming any knit lines (at least knit lines which are visible to the eye) between them thus producing an integral U-shaped structure when the next tile is placed in overlying relationship to tile 50A. U-shaped pattern 50 will further flatten in its dispensed top and bottom leg portions 62, 63 and its bight portion 64 as tile 50A is pushed downward into its laid position.

Figure 10:
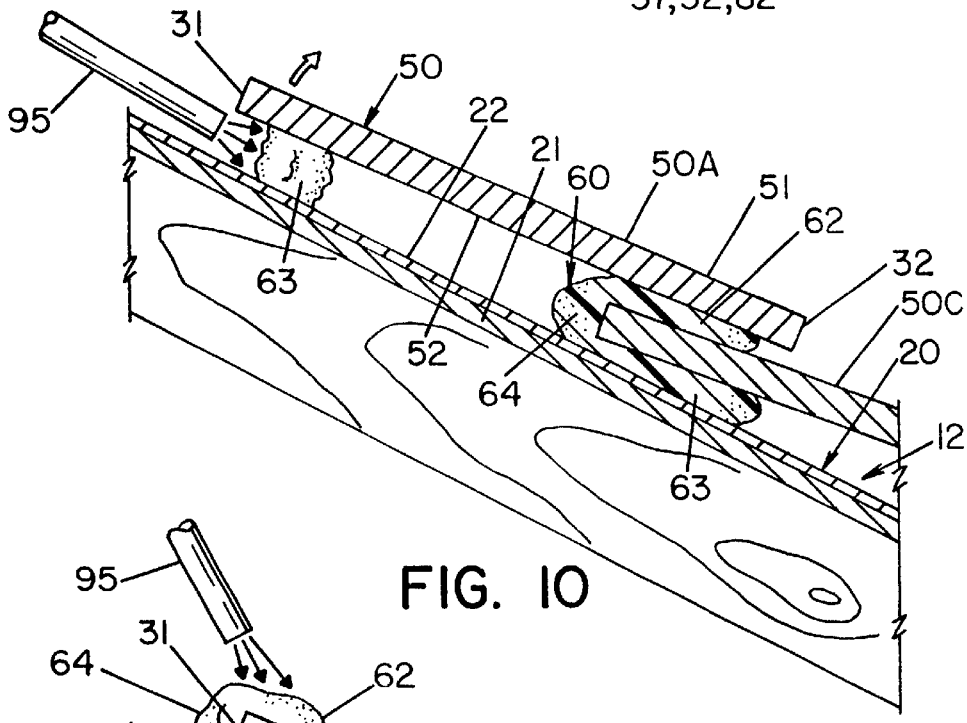
FIGS. 10 and 10A are cross-sectioned step views showing another way to form the inventive sandwich pattern.
Figure 10A:
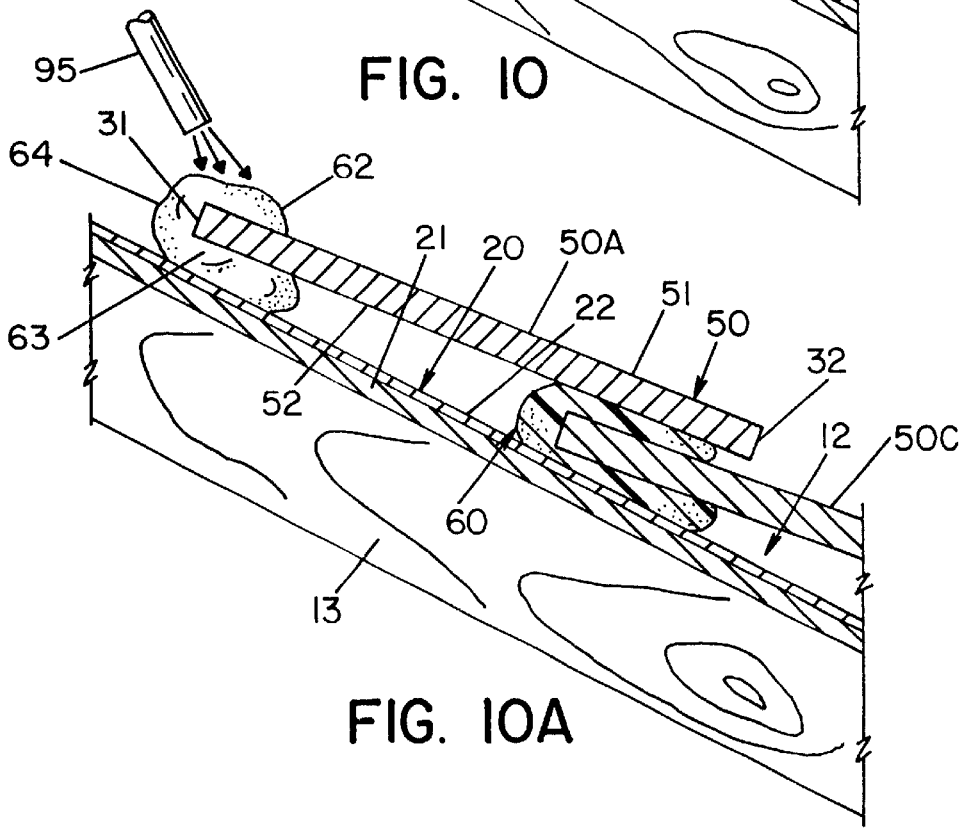

Still another way to form U-shaped adhesive pattern 60 is disclosed in FIGS. 10 and 10A. In FIG. 10, a tile, for example flat tile 50A, is placed in its vertical overlying position over lower tile 50C which has its U-shaped adhesive deposit 60 formed thereabout as shown. Leading edge 31 of tile 50A is lifted up and the user inserts dispenser nozzle 95 to dispense bottom leg deposit 63. Tile 50A is then released and the dispensing nozzle 95 continues to dispense a froth bead forming bight deposit 64 and top leg deposit 62. When the tile is equipped with an anchor lug it is possible to modify the application illustrated in FIG. 10 in that the dispensing nozzle can simply dispense the foam bead behind and on the side of and in front of the anchor lug without lifting the tile. In either instance, after U-shaped adhesive pattern 60 has been formed as shown in FIG. 10A, the tile is then placed firmly down into contact with U-shaped adhesive 60 at its trailing edge. As will be noted, the tiles will be laid in vertical progression from lowest to highest and not necessarily longitudinally in tile course. If the installer lays several tile courses, the U-shaped pattern is not to be applied until the overlying tile is ready for positioning. Removable shim blocks may be inserted.

Tests have been conducted which demonstrate that the roofing construction of the present invention has increased bonding strength when compared to my prior invention disclosed in the '536 patent. The present invention and my prior invention use approximately similar amounts of one-component foam when covering a roof.

Figure 12:
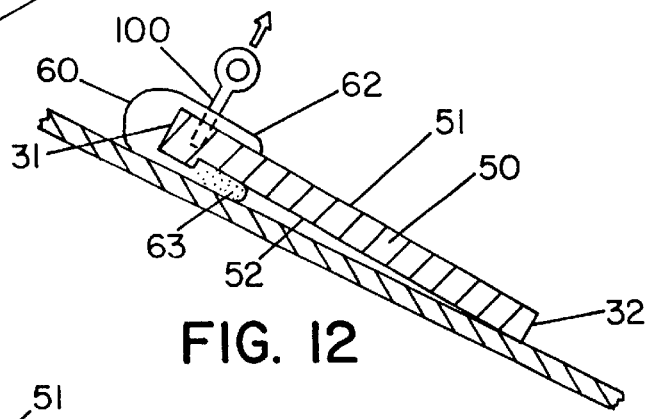
Figure 12A:
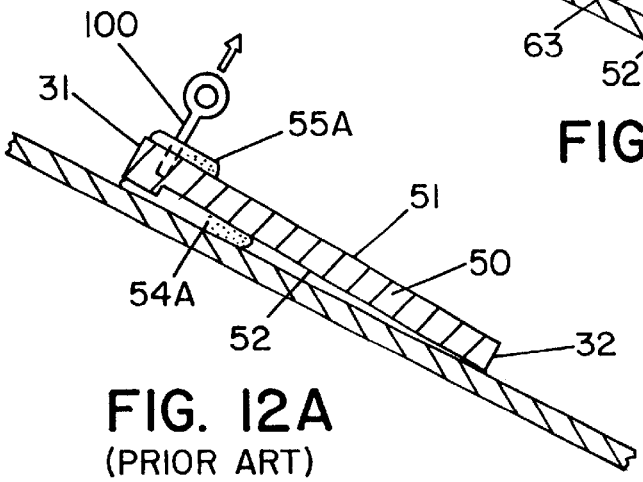
FIG. 12A (PRIOR ART)

A test was conducted to obtain some evaluation of the bonding characteristics of the present invention when compared to the paddy placement of my prior invention disclosed as prior art in FIG. 3. This test was not the type of test described in my '536 patent. Particularly, the overlying tile pattern in which U-shaped adhesive pattern 60 would produce a number of bond benefits as described above was not replicated. Instead, U-shaped adhesive pattern 60 was simply formed about leading edge 31 of the tile and the tile pulled from the roof substrate. Similarly, the paddy placement arrangement discussed in my '536 patent was likewise simply placed on a single tile and the tile pulled from the roof. The test arrangement for the present invention is schematically illustrated in figure 12 and the test arrangement applied to FIG. 3 prior art is schematically illustrated in FIG. 12A. More particularly, flat concrete tiles with an anchor lug was adhesively secured to roof substrate 20 as shown. Adhesive deposits for both systems were kept at the same approximate weight of about 12 to 14 grams. A hole was drilled through the deposits into the top surface of tile 50 and an anchor pin 100 was attached. A load cell (500 Westweight load cell with a computerized readout) was attached to anchor pin 100 and the tile was pulled from roof substrate 20 with the maximum force recorded by the load cell. Tests were conducted at a temperature of about 85° F. with a huymidity of 92% using the same adhesive foam, i.e., assignee's Handi-Stick® Roof Tile Adhesive. In all cases, the foam had only cured for 8 hours so the force levels recorded for both adhesive configurations would be expected to increase had the foam thoroughly cured although the overall results would not be expected to change. Results of the tests are tabulated below and show that the bond strength provided by the U-shaped adhesive of the present invention is stronger than the bond strength of the prior art system shown in FIG. 3. When lift tests are conducted with the tiles in their proper overlying relationship, the full benefit of bight portion 64 can be evaluated and it is expected that the bonding strength of the present invention for the roof system as a whole will show even more of an improvement than that shown in the results tabulated below:

| Test | U-shaped Adhesive | Prior Art FIG. 3 |
|---|---|---|
| 1 | 174 | 110 |
| 2 | 122 | 123 |
| 3 | 125 | 172 |
| 4 | 114 | 151 |
| 5 | 160 | 101 |
| 6 | 178 | 146 |
| Total | 873 | 803 |
| Average Force (ft-lbs) | 145.5 | 133.8 |

The invention has been described with reference to a preferred and alternative embodiments. Modifications and alterations will become apparent to those skilled in the art upon reading and understanding the Detailed Description of the Invention set forth above. It is intended to include all such modifications and alterations insofar as they come within the scope of the present invention.

Having thus defined the invention, it is claimed:

1. In a roof having a substrate, an underlayment covering the substrate and a plurality of roof tiles adhesively affixed to said substrate, the improvement comprising:

each roof having an underside, an outside, a leading edge, and tile being affixed to said roof by a one-component adhesive applied to individual roof tiles of said plurality of roof tiles in a U-shaped, continuous sandwiched pattern, one pattern for one roof tile, the pattern including a bottom leg adhesive deposit between the underside of any given roof tile and the roof substrate, a top leg adhesive deposit between the outside of the given tile and the underside of an overlying tile and a connecting bight adhesive deposit extending beyond the leading edge of the given tile and vertically extending between the underside of the overlying tile and the roof substrate.

2. The improved roof of claim 1 wherein said individual roof tiles are one or more tiles selected from the group consisting of flat tiles having a planar exterior configuration, high profile tiles having a non-planar exterior configuration and low profile tiles having a generally non-planar exterior configuration.

3. The improved roof of claim 2 wherein the one-component adhesive is a low density polyurethane foam having a density of between 0.8 to 4.0 lbs/ft.

4. The improvement of claim 3 wherein the area contacted by the U-shaped pattern between the roof and the underside of a given tile is about 10 $in^2$.

* * * * *